US007900744B2

(12) United States Patent
McLaughin et al.

(10) Patent No.: US 7,900,744 B2
(45) Date of Patent: Mar. 8, 2011

(54) SUPPORT ASSEMBLY

(75) Inventors: Neil Bernard McLaughin, Munruben (AU); Cameron MacMillan Baker, Kenmore (AU); David Palmer, Chelmer (AU); Ian Gillespie, Brookfield (AU); Anthony Finlay, Pullenvale (AU)

(73) Assignee: Standfast Holdings, LLC, Chicago, IL (US)

( * ) Notice: Subject to any disclaimer, the term of this patent is extended or adjusted under 35 U.S.C. 154(b) by 1019 days.

(21) Appl. No.: 10/530,862

(22) PCT Filed: Oct. 13, 2003

(86) PCT No.: PCT/AU03/01349

§ 371 (c)(1),
(2), (4) Date: Nov. 22, 2006

(87) PCT Pub. No.: WO2004/033256

PCT Pub. Date: Apr. 22, 2004

(65) Prior Publication Data

US 2007/0084666 A1 Apr. 19, 2007

(30) Foreign Application Priority Data

Oct. 11, 2002 (AU) ..... 2002951973
Aug. 22, 2003 (AU) ..... 2003236437

(51) Int. Cl.
*A62B 35/00* (2006.01)

(52) U.S. Cl. ..... 182/36

(58) Field of Classification Search ..... 182/36
See application file for complete search history.

(56) References Cited

U.S. PATENT DOCUMENTS

| | | | | | |
|---|---|---|---|---|---|
| 44,134 | A * | 9/1864 | Worsely | 105/457 |
| 1,395,559 | A * | 11/1921 | Davis | 105/142 |
| 2,696,917 | A * | 12/1954 | Kershaw | 212/179 |
| 4,353,308 | A * | 10/1982 | Brown | 105/29.1 |
| 5,537,933 | A * | 7/1996 | Ablad | 105/457 |
| 5,896,944 | A * | 4/1999 | McMillian et al. | 182/45 |
| 6,098,780 | A * | 8/2000 | Kelly et al. | 198/364 |
| 6,113,128 | A * | 9/2000 | Watkins | 280/647 |
| 6,485,039 | B1 * | 11/2002 | Ming-Fu | 280/87.041 |
| 2002/0056590 | A1 * | 5/2002 | Goldie et al. | 182/36 |
| 2002/0148680 | A1 | 10/2002 | Lee | |

FOREIGN PATENT DOCUMENTS

| | | |
|---|---|---|
| AU | 9873988 | 2/1998 |
| AU | 199873988 A | 1/1999 |
| AU | 199918533 A1 | 3/1999 |
| AU | 199918533 A | 9/2000 |

* cited by examiner

*Primary Examiner* — Alvin C Chin-Shue
(74) *Attorney, Agent, or Firm* — Vedder Price P.C.

(57) ABSTRACT

This invention relates of a support assembly (10) for a vehicle (16) of the type that includes an enclosed load carrying compartment (17) having a roof (18), said support assembly being adapted to provide support for a person when moving about on said roof. The support assembly includes a guide (11) that is mountable on the roof and a base (12) that is adapted to engage said guide and which is capable of movement along said guide while remaining engaged therewith. The support assembly also includes a support structure that includes a lower end portion that is pivotally connected to the base and a handle (15) that is spaced from said base. The support assembly also includes a lock (73) for selectively locking the support structure in a desired attitude relative to the base.

4 Claims, 7 Drawing Sheets

SUPPORT ASSEMBLY

CROSS-REFERENCE TO RELATED APPLICATIONS

This application is the U.S. National Phase of International Application PCT/AU2003/001349, filed Oct. 13, 2003, which designated the U.S. PCT/AU2003/001349 claims priority to Australian Application No. 2002951973 filed Oct. 11, 2002, and 2003236437 filed Aug. 22, 2003. The entire content of these applications are incorporated herein by reference.

BACKGROUND OF THE INVENTION

This invention relates to a support assembly.

This invention has particular, but not exclusive application to a support assembly for supporting a person when moving about on a roof of a vehicle, and for illustrative purposes reference will be made to same. However, it will be appreciated that the invention may be used in other applications where it is desirable to provide support for persons when engaged in activities that could result in them suffering a fall and injuring themselves, such as working on elevated structures, including buildings and bridges, or on moving structures, such as a pitching deck of a ship.

Most road and rail vehicles that are used to transport oil or other liquids in bulk include an elongate storage vessel having a generally elliptical transverse cross-section and a narrow, possibly arcuate, roof. Typically the storage vessel includes at least one inlet that is formed in the roof.

From time to time it is necessary, whether this be for maintenance or for filling the vessel, for persons to access the opening. Because of the narrowness of the roof and/or its arcuate shape, persons when walking and working on the roof have been known to loose their balance, resulting in a fall that can cause serious injuries.

Various safety apparatus for use by persons who are required to move about on elevated structures, such as the roof of a vehicle, are known. Typically the safety apparatus includes an elongate guide that is mounted on the structure and a support structure having a base that is adapted to engage said guide and which is capable of movement along said guide. The safety apparatus may also include a harness that the person can wear, and which itself is capable of being secured to the support structure.

Unfortunately, because of the design of the safety apparatus referred to above, typically the safety apparatus can only be accessed by persons once they are standing on the roof structure. Further, in order to stand on the roof structure, often it is necessary for the person to climb up a ladder and over an edge of the roof structure, which itself could cause the person to fall and hurt themselves.

SUMMARY OF THE INVENTION

It is an object of the present invention to provide a is support apparatus that ameliorates at least some of the deficiencies of the prior art.

With the foregoing in view, this invention in one aspect relates to a support assembly for a vehicle of the type that includes an enclosed load carrying compartment having a roof, said support assembly being adapted to provide support for a person when moving about on said roof, said support assembly including:

a guide that is mountable on said roof;

a base that is adapted to engage said guide and which is capable of movement along said guide while remaining engaged therewith;

a support structure that includes a first portion that is pivotally connected to said base and a second portion or handle that is spaced from said base, and a lock for selectively locking said support structure in a desired attitude relative to said base.

In another aspect, this invention relates to a vehicle, said vehicle including:

an enclosed load carrying compartment having a roof;

a guide that is mountable on said roof;

a base that is adapted to engage said guide and which is capable of movement along said guide while remaining engaged therewith;

a support structure that includes a first portion that is pivotally connected to said base and a second portion or handle that is spaced from said base, and a lock for selectively locking said support structure in a desired attitude relative to said base, and wherein use, a person may grasp hold of said handle for support and/or to move said base along said guide while walking on said roof.

In still yet another aspect, this invention relates to a support assembly, said support assembly including:

a guide;

a base that is adapted to engage said guide and which is capable of movement along said guide while remaining engaged therewith;

a support structure that includes a first portion that is pivotally connected to said base and a second portion or handle that is spaced from said base, and a lock for selectively locking said support structure in a desired attitude relative to said base.

In still yet another aspect, this invention relates to a structure having an elevated support surface that is capable of supporting a person moving about on same, said structure including:

a guide that is mountable on the elevated support surface;

a base that is adapted to engage said guide and which is capable of movement along said guide while remaining engaged therewith;

a support structure that includes a first portion that is pivotally connected to said base and a second portion or handle that is spaced from said base, and a lock for selectively locking said support structure in a desired attitude relative to said base, and wherein use, a person may grasp hold of said handle for support and/or to move said base along said guide while moving about on the elevated support surface.

The elevated support surface may include the roof of a building, a piece of scaffolding, or a platform suspended beneath a billboard.

The guide may be substantially straight or arcuate. Further, the guide may be of unitary construction, or may comprise a plurality of individual guide elements that when arranged end to end form said guide.

The guide may be any suitable shape. For example, the guide may have an external cross-sectional shape that is round, square or polygonal, and wherein the guide may be of solid or tubular construction.

The guide may also include attachment means for attaching the guide to a roof, or similar structure. For example, the attachment means may include a plate or flange that is attached to an underside of the guide, and which may include one or more apertures formed therein.

The base may include an opening through which the guide extends. For example, the base may include a pair of jaws that may be fixed or moveable, and which may either at least partially surround or clamp about the guide.

Alternatively, in another embodiment, the base may include a protrusion that is locatable within a channel shaped recess that is formed in and which extends along the length of the guide. Further, the internal cross-sectional shape of the recess and the external cross-sectional shape of the protrusion may be complementary, and may be designed so that the protrusion cannot be withdrawn from the recess.

The base may also include a mounting to which the support structure can be pivotally connected. The mounting may include a mounting plate or flange, or a pair of opposing mounting plates or flanges, each having a mounting aperture formed plates or flanges, each having a mounting aperture formed therein through which a mounting pin or such like may extend.

The support structure in it's simplest form may comprise a post having a free end portion that is capable of serving as a handle. For example, the support structure may resemble a walking stick. However, in other embodiments, the support structure may be more complex, and may include one or more bracing members and such like.

The lock may include an actuator for selectively engaging and disengaging the lock. The actuator is preferably located on the handle of the support structure or on the support structure, adjacent said handle.

In one embodiment, the lock may be adapted to selectively engage discrete locations on the base, such as the mounting. These locations may coincide with predetermined preferred positions of the support structure relative to the vehicle to which the support assembly is attached.

Alternatively, the lock may be adapted to engage the base, such as the mounting, at any position between opposing limits on the said base.

The support assembly may also include braking means for checking movement of the base along the guide. Like the lock, the brake may include an actuator for selectively engaging and disengaging the brake. The actuator is preferably located on the handle of the support structure or on the support structure, adjacent said handle.

In one embodiment, the brake may be adapted to selectively engage discrete locations on the guide. These locations may coincide with predetermined preferred positions of the support assembly relative to the vehicle, such as the position of an access opening.

Alternatively, the brake may be adapted to engage the guide anywhere between opposing ends of said guide.

Preferably, the support assembly includes both a lock and a brake.

Further, the load carrying compartment may include a side wall to which there is attached a ladder or in which there is formed a plurality of steps that may be used to gain access to the roof. Preferably the support assembly may be positioned on the roof such that the handle may be grasped by a person while is climbing the ladder or the steps for support.

It is also Preferred that the support structure is capable of moving between a generally horizontal attitude, or first position, and a generally vertical attitude, or second position. Preferably, as the user moves up or down the ladder or steps, the user can alter the attitude of the support structure to suit his position on said ladder or said steps whereby the handle continues to provide support for the user.

The support assembly may also include a harness, lifeline or a similar device that may be attached to a user.

The support assembly may also include a fastening or anchor to which a harness, a life line or similar device may be secured to said support assembly. The fastening may be a ring or eye attached to or which forms part of the post. Alternatively, the fastening may be a line member, such as a rail.

BRIEF DESCRIPTION OF THE DRAWINGS

In order that the invention may be more fully understood, a preferred embodiment will now be described with reference to the accompanying drawings, in which.

DETAILED DESCRIPTION

Figure 1:
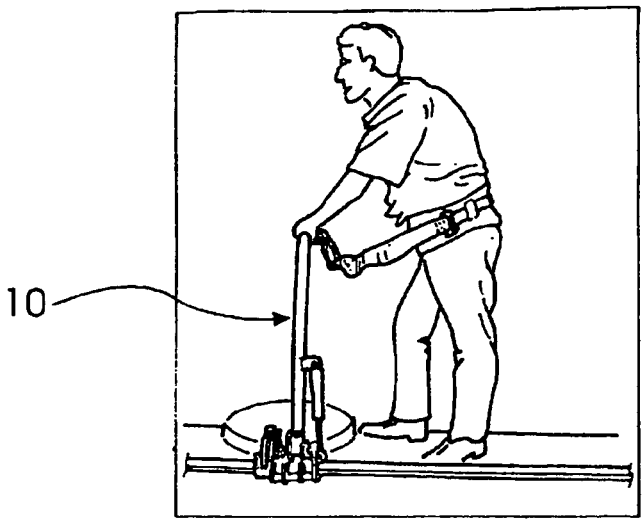
FIG. 1 shows a side view of a vehicle on which there is mounted a support assembly constructed in accordance with the present invention.
Figure 2:
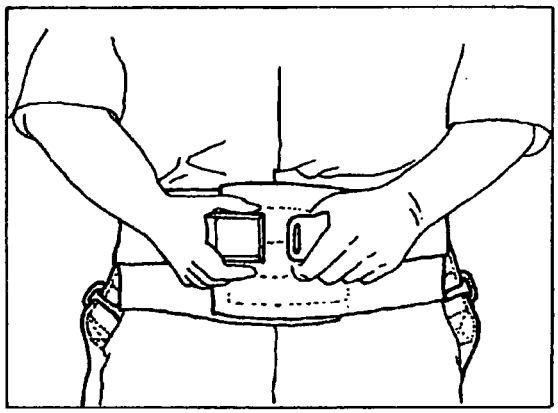
FIG. 2 shows a person fitting a harness to their body.
Figure 3:
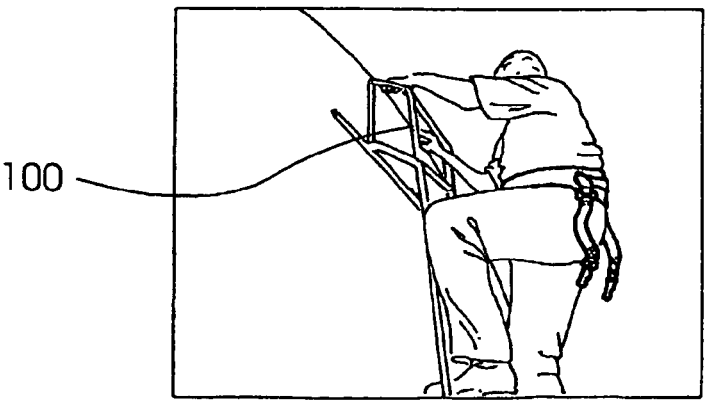
FIG. 3 shows the person climbing a ladder mounted on a side of the vehicle.

FIGS. 1, 4, 5 and 6 show the support assembly 10 mounted on a vehicle 16 of the type that is commonly used to transport oil and other liquids in bulk. The vehicle 16 includes an elongate storage vessel 17 having a generally elliptical transverse cross-section and a narrow roof 18, and wherein partway between opposing ends of the roof 18 there is a provided an access port 19.

Figure 7:
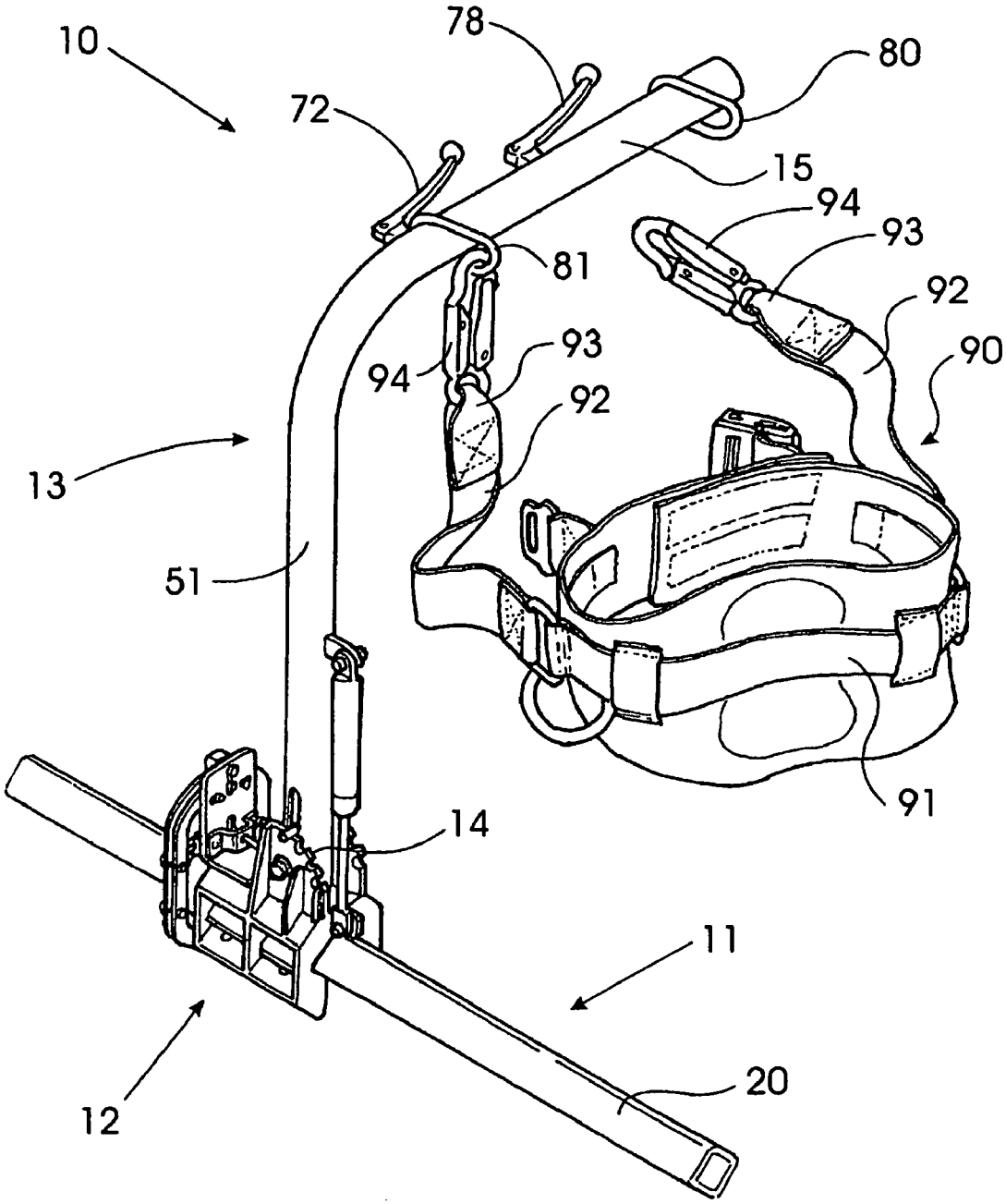
FIG. 7 shows a pictorial view of the support assembly, including the harness.
Figure 8:
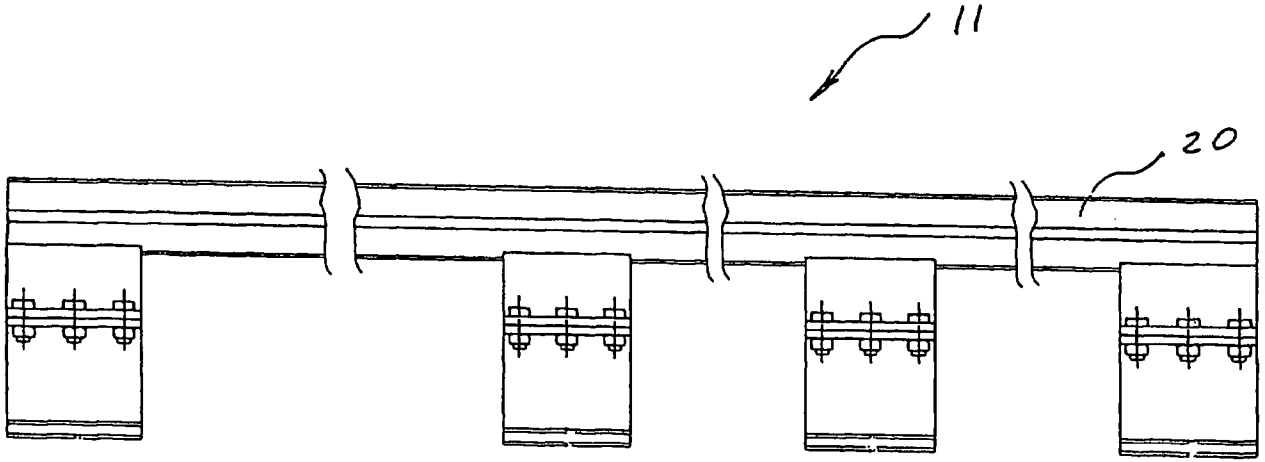
FIG. 8 shows a side view of a guide for the support assembly.
Figure 10:
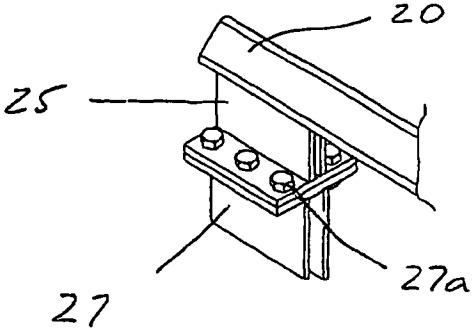
FIG. 10 shows a pictorial view of a section of the guide when viewed from above.
Figure 9:
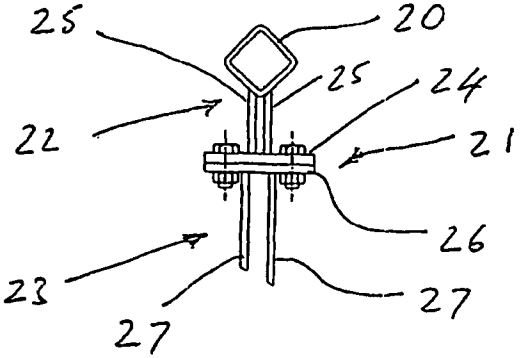
FIG. 9 shows an end view of the guide.
Figure 11:
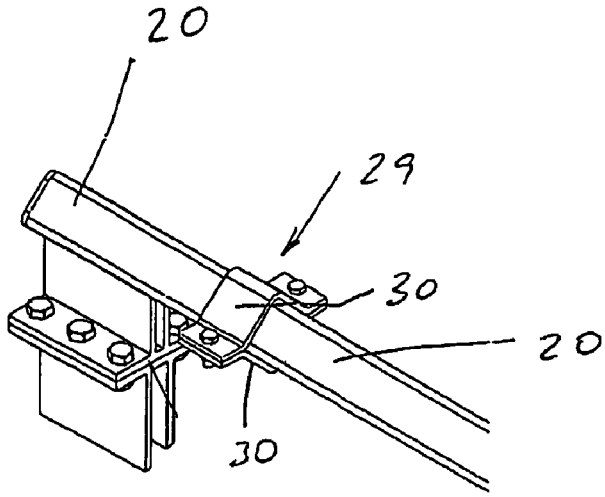
FIG. 11 shows a pictorial view from above of one end of the guide.
Figure 12:
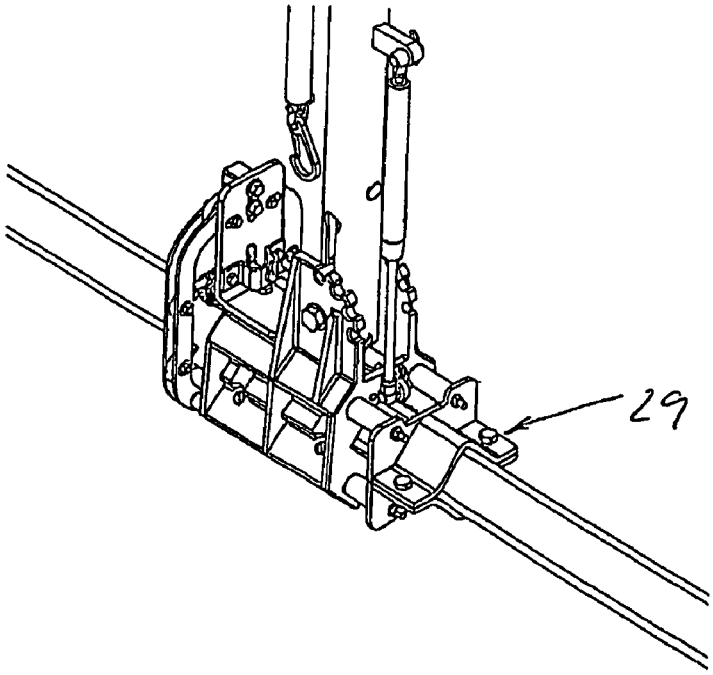
FIG. 12 shows a pictorial view from above of a base and lower end portion of a support structure of the support assembly.
Figure 13:
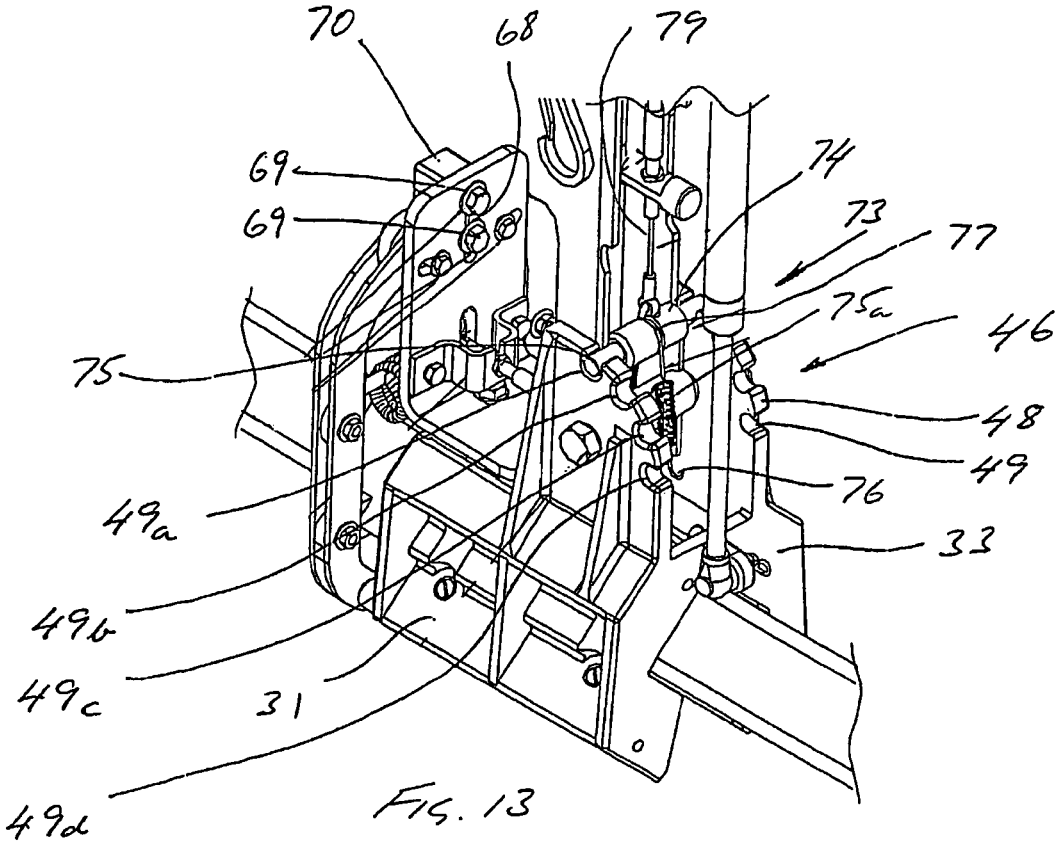
FIG. 13 shows a pictorial view from above of the base and lower end portion of the support structure.
Figure 14:
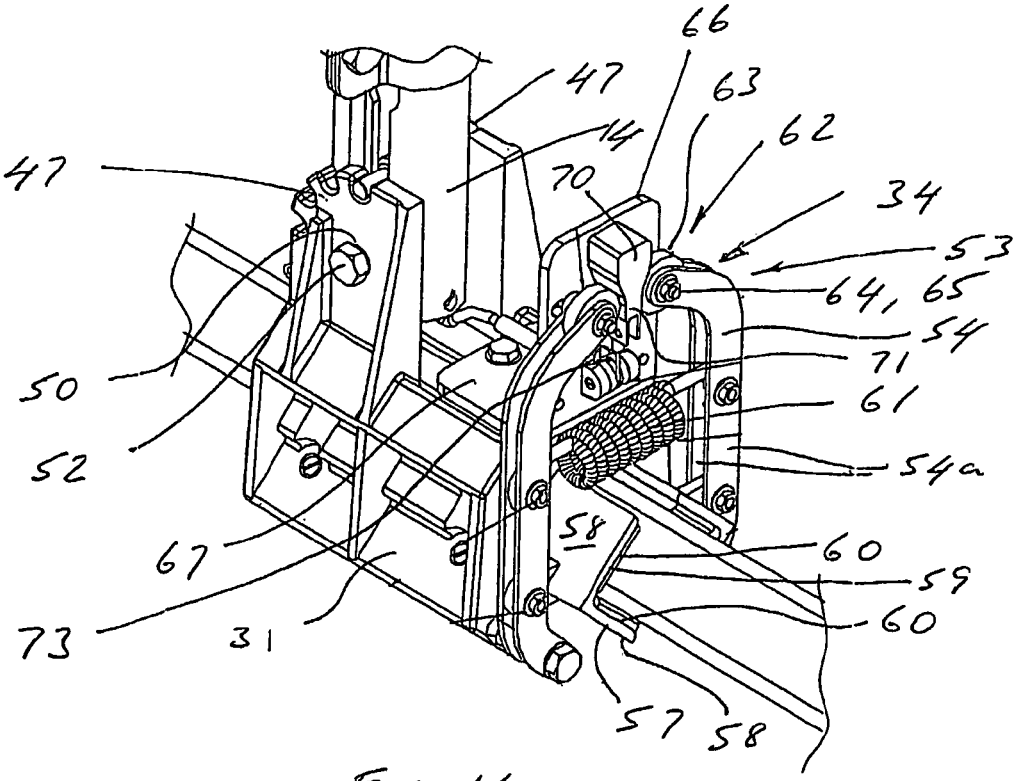
FIG. 14 shows a pictorial view from above of the base and lower end portion of the support structure.

FIG. 7 shows a support assembly 10 that includes an elongate guide 11, a base 12 and a support structure 13.

The base 12 is adapted to engage the guide 11 and is capable of movement along said guide while remaining engaged therewith.

The support structure 13 has a lower end portion 14 that is pivotally connected to the base 12, and a handle 15 that is spaced from said base.

The guide 11 comprises an elongate piece of tubular steel section 20 having a generally square shaped transverse cross-section. The steel section 20 is attached to and extends longitudinally along the roof 18 of the vehicle 16 by a plurality of connectors 21.

Each connector 21 comprises a first part 22 attached to the steel section 20 and a second part 23 that is attached to the roof 18. The first part 22 includes a mounting plate 24 that is spaced from the steel section 20 by two opposing flanges 25 that depend from the underside of the guide 11.

The second part 23 includes a mounting plate 26 that is spaced from the roof 18 by two opposing, upstanding, flanges 27 that are welded to the roof 18.

The two mounting plates 24 and 26 are bolted together using bolts 27*a*, as shown in FIGS. 8 to 11.

At each opposing end 28, of the guide 11, there is provided a stop 29. The stop 29, comprising two opposing pieces of bent plate 30, bolted together, is used to limit the travel of the base 12 along the guide 11.

The base 12 includes a body 31 in which there is formed a longitudinally extending channel 32. The channel 32 has a square shaped transverse cross-section, and is adapted to loosely receive the tubular section 20 therein.

The body 31 also includes a front end portion 33 and a rear end portion 34, each of which has three recesses 35, 36 and 37 respectively that are formed therein. Each of the recesses includes two opposing side walls 38 that are separated by a web 39.

Figure 15:
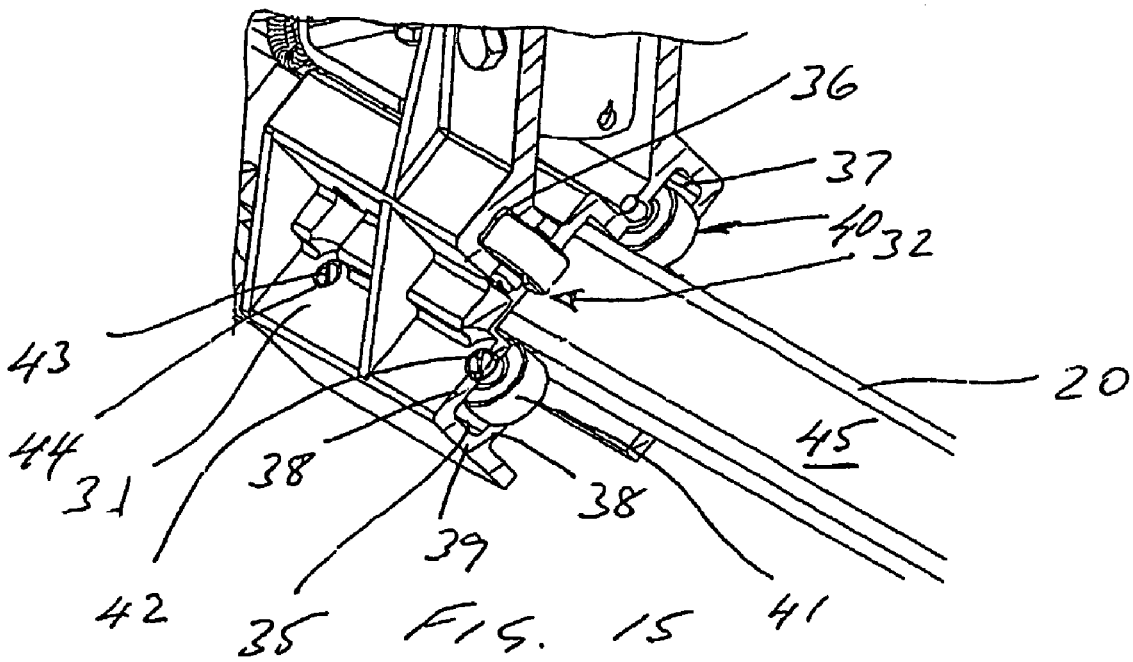
FIG. 15 shows a cross-sectional pictorial view from above of the base and lower end portion of the support structure.

The recesses 35, 36 and 37 are each adapted to receive a roller assembly 40, comprising a wheel 41 that is free to rotate about an axle 42 having opposing end portions 43 that are each located within a respective aperture 44 formed in a side wall 38. The wheels 41 each bear against a respective side wall 45 of the steel section 20, as shown in FIG. 15.

The base 12 also includes a mounting 46, including two opposing, upstanding, flanges 47 located intermediate the front and rear end portions 33 and 34. The flanges 47 each include an arcuate edge portion 48 in which there is formed four semi-circular notches 49. Each of the flanges 47 also includes a mounting aperture 50 formed therein.

The support structure 13 is constructed from a tubular member that has been bent so that it resembles a walking stick, comprising a post 51, having a lower end portion 14, and a handle 15 that extends outwardly from the post 51 in a generally orthogonal direction. The lower end portion 14 is pivotally connected to the mounting 46 by a bolt 52 that extends through opposing mounting apertures 50.

The support structure is equipped with braking means 53, including a pair of opposed clamping arms 54, each comprising a pair of clamping members 54*a*, each having a fixed end 55 and a free end 56. Each clamping arm 54 includes a jaw 57, located adjacent the free end 56, that comprises a pair of divergent flanges 58, having an inner face 59 on which is mounted a pad 60. The jaws 57 are each adapted to grip an adjacent pair of faces of the steel section 20.

The two clamping arms 54 are connected midway between their respective ends by a coiled spring 61. The action of spring 61, in use, is to urge the clamping arms 54 together thereby maintaining the pads 60 in contact with the steel section with sufficient force that the base 12 is restrained from moving relative to the guide 11.

The fixed end 55 of each clamping arm 54 includes a roller assembly 62, comprising a wheel 63 that is free to rotate about an axle 64, being the shaft of a bolt 65 that pivotally connects the clamping arm 55 to a flange 66 of an "L" shaped mounting bracket 67.

The flange 66 includes a slotted aperture 68 through which two bolts 69 extend, said bolts being used to slideably connect a cam member 70, that resembles a wedge, thereto.

The lower end 71 of the cam member 70 is connected to a brake handle 72, mounted on the handle 15, by a wire cable 73. The brake handle 72 is capable of movement between a first position, wherein the cam member is in it's upper most position, and a second position, wherein the cam member is in it's lower most position. The brake handle 72 is maintained in the first position by the action of a spring, not shown.

When the cam member 70 moves from it's first position to it's second position, the engagement of the cam member 70 with the two wheels 63 causes the disengagement of the jaws 57 with the steel section 20, thereby permitting movement of base 12 along the guide 11. However, when pressure brought to bear on the brake handle 72 by the user is released, the brake handle is automatically returned to it's first position; the cam member 70 returns to it's uppermost position, and the jaws 57 again engage the steel section 20 thereby resisting further movement of the base 12 relative to the guide 11.

The support structure 13 also includes locking means 73, including a locking pin 74 having opposed free end portions 75 that are each receivable within a respective notch 49. Further, the locking pin 74 is retained in an engaged position with the notches 49 by the action of a coiled spring 75*a*, having a first end 76 that is secured to the base 12 and a second end 77 that is attached to a mid portion of said locking pin 74.

The mid portion of the locking pin 74 is connected to a locking handle 78, mounted on the handle 15, by a wire cable 79. The locking handle 79 is capable of movement between a first position, wherein the locking pin 74 is in engagement with a pair of notches 49, and a second position, wherein the locking pin 74 is no longer in engagement with said notches 49. The locking handle 79 is maintained in the first position by the action of a spring, not shown.

When the locking pin 74 moves from an engaged position to a disengaged position, the post 51 is free to move between a first, or generally upstanding attitude, and a second, or generally horizontal attitude, said first and second positions corresponding to notches 49*a* and 49*d* respectively. The notches 49*b* and 49*c* correspond to attitudes of inclination approximately 60 degrees and to 30 degrees to the horizontal.

However, when pressure brought to bear on the locking handle 79 by the user is released, the locking handle is automatically returned to it's first position and though the free ends of the locking pin 74 will continue to slide along the arcuate edges 48 with rotation of the post 51, they will automatically engage a respective notch 49 when located over same, and shall remain in engagement therewith due to the action of the spring 75*a*, thereby preventing further movement of the post 51 relative to the base 12.

The handle 15 includes two links 80 and 81 that are attached thereto.

The support assembly 10 also includes a harness 90, consisting of a belt 91 that may secured about a user's waist, and two straps 92, each having a fixed end that is attached to the belt 91 and a free end 93 equipped with a clasp 94. In use, the clasps 94 may each be connected to a respective link 80 or 81, if so desired.

FIGS. 1 to 6 show the support assembly 10 in use. Specifically, once the harness 90 has been secured about the user's waist, the user then uses the ladder 100 to climb up the side of the rear 101 of the storage vessel 17.

When the user reaches the top of the ladder, the user may secure at least one of the clasps 94 to one of the links 80 or 81. Consequently, should the user slip or loose their balance while climbing on to the roof 18, they will not fall and injure themselves.

Figure 4:
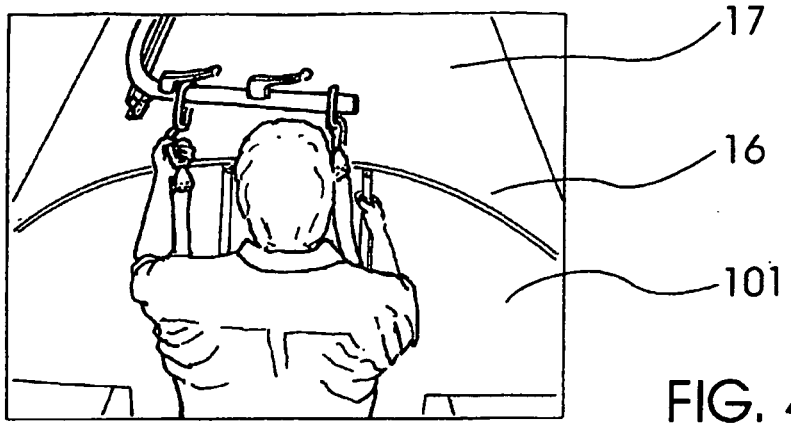
FIG. 4 shows the person securing the harness to the support assembly.
Figure 5:
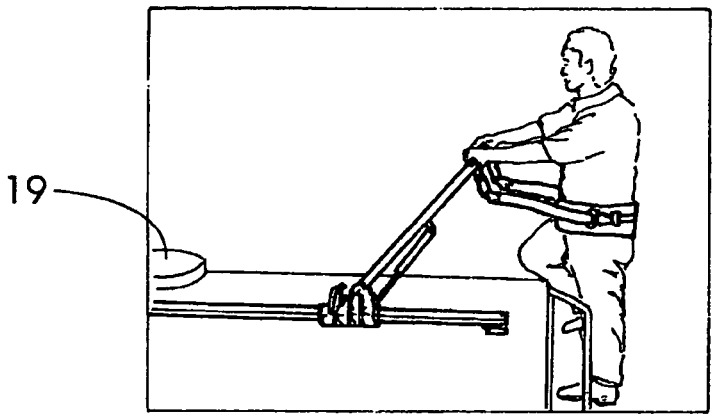
FIG. 5 shows the person continuing to climb the ladder while using the support assembly for support.
Figure 6:
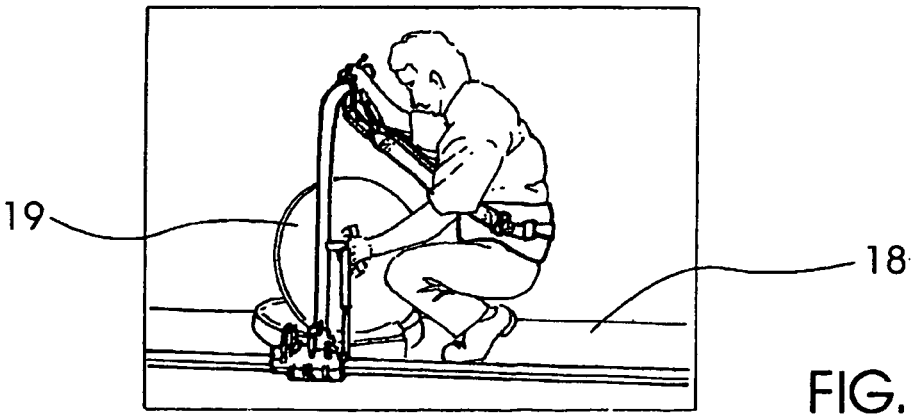
FIG. 6 shows the person using the support assembly for support while working on a roof of the vehicle.

While continuing to climb the ladder 100, the user may grasp hold of the handle 15 for support, which in the position shown in FIG. 4 extends rearwardly beyond the edge of the roof 18. When the support assembly 10 is in this position, the body 12 abuts against the stop 29 located nearest to the ladder 100.

Before placing his or her feet on the upper most rungs of the ladder 100, the user can, by pulling on the locking handle 79, disengage the locking pin 74 and the notches 49*d*, raise the handle 15, which itself can then be locked in place by releasing the locking handle such that the locking pin engages notches 49*b* or 49*c*. By repositioning the handle 15, which is now higher and located over the roof 18, it is believed that the user will find it easier to climb on to the roof 18.

Once standing on the roof 18, the user may by pulling on the locking handle 79, disengage the locking pin 74 and the notches 49*b* or 49*c*, move the post 41 such that it now stands upright, which itself can then be locked in place by releasing the locking handle such that the locking pin engages notches 49*a*.

In order then to move the support structure 13 along the guide 11 while holding on to the handle 15 for support, the user must pull on the brake handle 72 so as to disengage the jaws 57 and the steel section 20.

Similarly, in order to prevent further movement of the support structure 13 along the guide 11, such as while working near an access opening, the user need only release their grip on the brake handle 72 so as to permit engagement of the jaws 57 with the steel section 20.

When ascending from the roof 18, engagement of the body 12 with the stop 29 located at the end of the guide 11 nearest the ladder 100 will prevent the user, who may be walking backwards, from stepping off the edge of the roof 18.

Further, when the body 12 abuts against the stop 29 nearest the ladder 100, the support assembly 10 is located in the preferred position to enable the user to climb down from the roof 18 while using the moveable support structure 13 for support, much like the user did when climbing on to the roof 18. When climbing down from the roof 18 using the ladder 100, the procedure just described may be followed in reverse.

It will be appreciated that the support assembly 10 offers a safer alternative to working on elevated structures, such as a storage vessel, than the prior art. Further, it will be appreciated that the support assembly 10 may be used in other applications to provide support for persons when moving about on an elevated support surface of a structure. For example, the support assembly 10 may be used to support a person while working on the roof of a building, on scaffolding or a platform beneath a billboard.

It will also be appreciated that the support assembly 10 offers considerable assistance to persons when climbing on to or getting down from an elevated support surface, such as the roof of a building.

It will also be appreciated that the above example is given as an illustration only of the present invention and that all such modifications thereto as would be apparent to persons skilled in the art are deemed to fall within the broad scope and ambit of this invention as herein defined in the appended claims.

The claims defining the invention are as follows:

1. A method for operating a support assembly on a structure having an elevated surface capable of supporting a person moving about on same, the structure comprising a guide mountable on the support surface, a base adapted to engage the guide and capable of movement along said guide while remaining engaged therewith, and a support structure including a first portion that is pivotally connected to the base and a handle with a link spaced away from the based, a lock on the handle for selectively locking the support structure in an intermediate attitude relative to said base at an inclination between a generally upstanding attitude and a generally horizontal attitude, and a braking means for selectively locking the base in a desired position relative to said guide, the method comprising the steps of:

securing a harness with at least a clap to a person;

securing the at least a clap to the link on the handle;

grasping the handle;

grasping the lock for pivotally disengaging the support structure from the base;

pivoting the support structure to a different attitude relative to said base in an intermediate attitude;

releasing the lock for securing the support structure at the different attitude;

engaging the braking means to release the base in relation to the guide;

moving the base in relation to the guide; and disengaging the braking means to secure the base in relation to the guide.

2. The method for operating a support assembly of claim 1, wherein the structure further comprises a ladder adjacent to the support surface, and wherein the method further comprises the steps of climbing the ladder before the step of securing the claps, and the step of stepping of the ladder onto the support surface before the step of disengaging the braking means.

3. The method of claim 2, wherein the elevated support surface is a roof.

4. The method of claim 2, wherein a stop is mounted on the guide, and wherein the method further comprises the step of abutting the base against the stop to enable the person for climbing down the ladder while the support assembly is at a preferred position.

* * * * *